US005941778A

United States Patent [19]

Vasalech

[11] Patent Number: 5,941,778

[45] Date of Patent: Aug. 24, 1999

[54] LUMINESCENT BILLIARD GAME SYSTEM

[76] Inventor: Glen A. Vasalech, 112 St. Rose Ave., St. Rose, La. 70087

[21] Appl. No.: 09/020,886

[22] Filed: Feb. 9, 1998

[51] Int. Cl.[6] ..... A63D 15/00

[52] U.S. Cl. ..... 473/1; 273/DIG. 24; 473/44

[58] Field of Search ..... 473/34, 1, 44; 273/DIG. 24

[56] References Cited

U.S. PATENT DOCUMENTS

| | | | |
|---|---|---|---|
| 280,807 | 7/1883 | Farley | 273/DIG. 24 |
| 716,645 | 12/1902 | Ransom | 273/DIG. 24 |
| 1,662,421 | 3/1928 | Herold et al. . | |
| 3,464,703 | 9/1969 | Vallas | 273/DIG. 24 |
| 3,649,028 | 3/1972 | Worrell | 273/DIG. 24 |
| 3,709,495 | 1/1973 | Krombein | 273/DIG. 24 |
| 3,717,343 | 2/1973 | Hartford | 273/DIG. 24 |
| 3,738,655 | 6/1973 | Feddick et al. | 273/59 A |
| 3,917,264 | 11/1975 | Davidson et al. | 273/DIG. 24 |
| 3,971,560 | 7/1976 | Panosh | 273/DIG. 24 |
| 4,142,720 | 3/1979 | Davis | 273/59 A |
| 4,392,652 | 7/1983 | Knight | 273/DIG. 24 |
| 4,396,192 | 8/1983 | Fitzpatrick | 273/59 B |
| 4,840,383 | 6/1989 | Lombardo | 273/DIG. 24 |
| 4,846,475 | 7/1989 | Newcomb et al. | 273/128 R |
| 5,042,803 | 8/1991 | Fox et al. | 273/59 R |
| 5,087,050 | 2/1992 | Donovan | 273/DIG. 24 |

*Primary Examiner*—William H. Grieb
*Attorney, Agent, or Firm*—Joseph N. Breaux

[57] ABSTRACT

A luminescent billiard game system is disclosed providing an interesting and fun variation of the game which allows the game to be played in limited lighting conditions. The system comprises a billiard table having a number of luminescent surfaces which indicate the table perimeter edges, pocket locations, starting lines, distance indicators, and center point of the table. Additionally, cue stick tips are provided with luminescent material along with the billiard balls. A cabinet is also provided for charging the cue sticks and balls with concentrated light, for billiard tables not equipped with automatic ball returns, the light is activated upon closure of the cabinet and includes highly reflective interior surfaces. A ball bin charging light is also provided for charging balls on billiard tables equipped with automatic ball returns, while the charging light is also utilized to transmit light, optic fibers, to desired locations on the billiard table.

4 Claims, 5 Drawing Sheets

LUMINESCENT BILLIARD GAME SYSTEM

TECHNICAL FIELD

The present invention relates to devices and methods for playing the game of billiards and more particularly to devices and methods for providing a luminescent billiard game system that allows billiards to be played in limited lighting conditions and also providing a luminescent charging means which provides a means for charging the billiard balls and cue stick luminescent tips.

BACKGROUND ART

The game of billiards has existed for years and has historically been played in darkened bars and clubs which leads to assorted problems with locating the billiard balls, locations on the billiard table, and the cue sticks. Despite the existence of these problems for many years, there has never been a device, like the present invention, which provides luminescent components of the billiard table, balls and cues and a means for charging the balls and cues with luminescence which allows the game to be played in low light conditions.

A "black light radiating" billiard game was claimed by Davidson et al U.S. Pat. No. 3,917,264 which provides balls, cue sticks, and certain portions of the billiard table to be coated with luminescent material that is responsive to black light. The Davidson et al billiard game also includes a strobing black light which allows the moving balls to be trailed in the darkness. This device differs from the present invention in that a charging means is not provided for charging the billiard balls and cues with light, not does the Davis device describe a means for transmitting luminescent light to specific locations on the billiard table. The charging means includes a means for charging billiard balls for tables with automatic ball returns, and an alternative means for charging balls when the table is not equipped with automatic ball returns. A charging cabinet is provided where balls are stored, where a charging light operates automatically when the cabinet doors are closed, which prevents light from the cabinet to fill the room when the cabinet is opened. A ball return bin charging light is provided for tables which include automatic ball return to a centrally located bin. The ball return bin light is also coupled to an optic fiber or multiple optic fibers which are then run to strategic locations on the billiard table to transmit the light to the desired areas of the table. The optic fiber light transmission system coupled to the ball bin light assures consistent brightness for the illuminated areas of the table and constant recharging of the balls as they sit in the ball return bin. For the tables without automatic ball returns two sets of balls are used, one set on the billiard table and the other set in the charging cabinet, this assures highly luminescent balls are on the billiard table at all times.

Other devices have been disclosed and claimed which provide a means for illuminating different playing balls. Such as a luminescent golf ball in U.S. Pat. No. 1,622,421; a luminescent tennis ball in U.S. Pat. No. 716,645; luminescent strips on a croquet ball U.S. Pat. No. 280,807; and an illuminated translucent hockey puck U.S. Pat. No. 4,846,475. The present invention not only includes a means for illuminating the billiard balls, as the prior art, but also providing a convenient and efficient means of assuring that the playing balls are charged with luminescence as often as possible, while also providing illuminating portions of the billiard table, thus overcoming the problem of reduced luminescence over time.

GENERAL SUMMARY DISCUSSION OF INVENTION

It is thus an object of the invention to provide a Luminescent Billiard Game System that provides a means for playing billiards in low light conditions.

It is a further object of the invention to provide a Luminescent Billiard Game System that provides luminescent portions of a billiard table, billiard balls, cue stick tips, and a means for maintaining or recharging the luminescence in the billiard balls.

It is a still further object of the invention to provide a Luminescent Billiard Game System that provides luminous billiard table edges, starting lines, center point, pocket backs, table distance indicators, billiard balls and cue stick tips and a means for assuring the luminescence of the billiard balls which comprises a lighting system within a cabinet for storing the balls or if the billiard table is equipped with automatic ball returns a lighting system within the ball return bin.

It is a still further object of the invention to provide a Luminescent Billiard Game System that provides luminous billiard table edges, starting lines, center point, pocket backs, table distance indicators, billiard balls and cue stick tips and a means for assuring the luminescence of the billiard balls for a billiard table with automatic ball return which comprises a lighting system within the ball return bin and wherein the lighting system includes an optic fiber transmission system from the bin light to illuminate locations on the billiard table.

It is still a further object of the present invention to provide a Luminescent Billiard Game System which provides luminous billiard table edges, starting lines, center point, pocket backs, table distance indicators, billiard balls and cue stick tips and a means for assuring the luminescence of the billiard balls for a billiard table without automatic ball return which comprises a lighting system within a cabinet wherein the cabinet stores and charges the balls and cues with luminescence while the balls are contained in a highly reflective container, and wherein the light is deactivated when the cabinet doors are opened, furthermore the luminent components contain or have affixed a luminescent compound.

Accordingly, a Luminescent Billiard Game System is disclosed and claimed which includes luminescent components of the billiard table, including the table edges, starting lines, pocket backs, table distance indicators, billiard balls, and cue stick tips, while a means is provided to assure the luminescence of the billiard balls over an extended time for billiard tables installed with either automatic or non automatic ball returns and wherein the luminescent locations are illuminated by either a luminescent material attached to or made part of the component or location indicated or by transmitting light to the locations with optic fibers.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
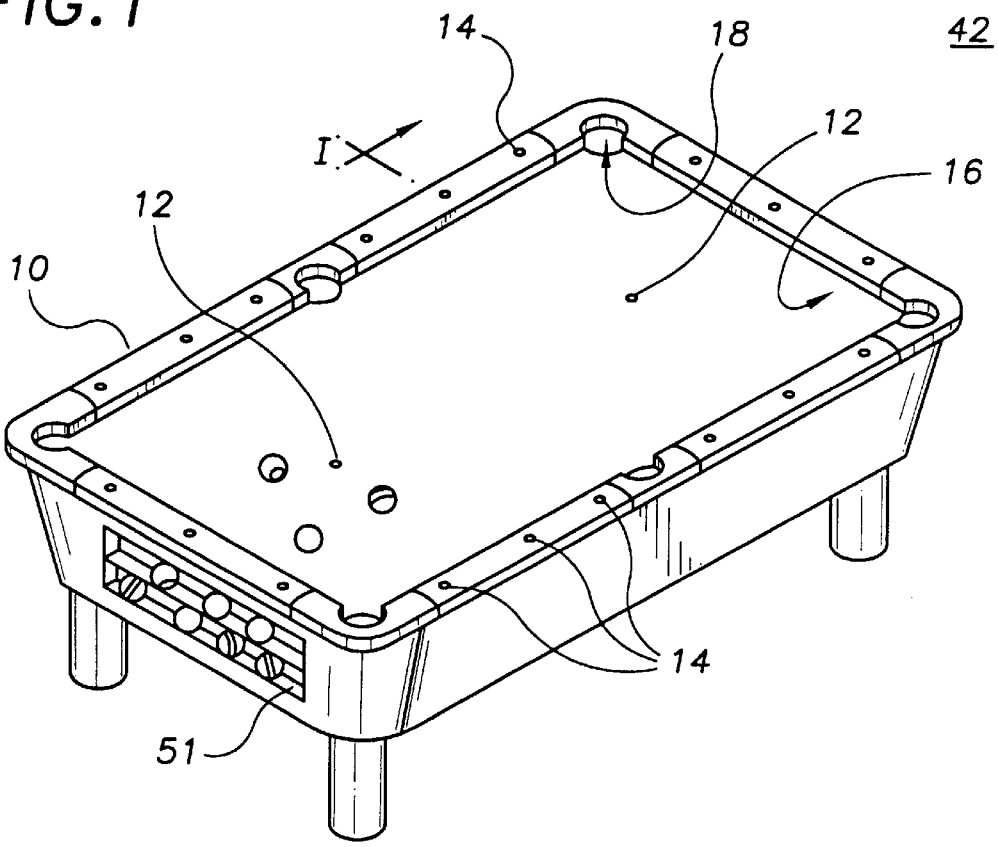
FIG. 1 is a billiard table illustrating the luminescent locations.
Figure 2:
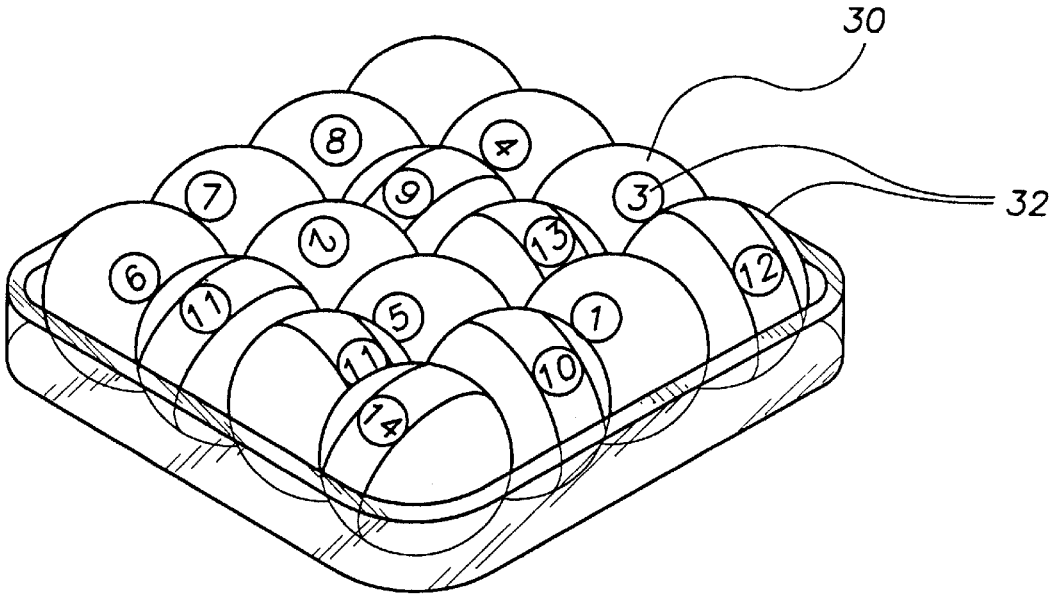
FIG. 2 is a set of billiard balls illustrating the location of luminescent material on the balls.

It can be seen from the preceding description that the Luminescent billiard game is played as other billiards however, the invention allows the players to continue play in dim lighting conditions. Furthermore, the invention allows for locations on the billiard table and the billiard balls to be quickly ascertained. An important aspect of the invention is the means which provides for ball luminescent charging. In one aspect of the invention, wherein a billiard table is equipped with automatic ball returns, a luminescent charging lamp is located in the ball return bin of the table, so that as balls are collected in the bin they are exposed to the recharging light thus assuring maximum luminescence when the balls are removed from the bin for more play. In another aspect of the invention, wherein a billiard table is not equipped with automatic ball return, a charging cabinet which is lined with highly reflective material and a lighting source provides a temporary storage facility for balls and cues and a means for recharging the balls and cues luminescence. "Automatic ball return" means that when a ball enters any pocket on the billiard table the ball is delivered to a temporary storage bin, all balls that enter pockets are delivered to the same storage bin, which is usually located at one end of the billiard table. Although the cabinet charging means is preferable used with billiard table not equipped with automatic ball returns, this charging means may also be used on table that are equipped with automatic ball returns. However, the storage bin charging means cannot be used on billiard tables not equipped with automatic ball returns. The inventor has found that the ball luminescence charging means overcomes the problems associated which luminescent depletion over time after the balls have been removed from a light source.

Referring to the figures, the luminescent billiard game system includes the billiard table 10, which is fitted with numerous illuminated locations such as the center point 12 at each end of the table, distance indicators 14, edge illuminators 16, and pocket backs 18. The cue sticks 20 are equipped with tip illuminator sections 22, while the balls 30 have illumination portions 32 coinciding with the lighter sections of the balls 30.

The illuminating material for the locations may be provided by a light absorbing and emitting additive to the plastic resin which makes-up the particular component, or may include the additive added to an adhesive backed sticker for attachment to the component or area. Numerous plastic additives known to those skilled in the art may be employed.

Figure 6:
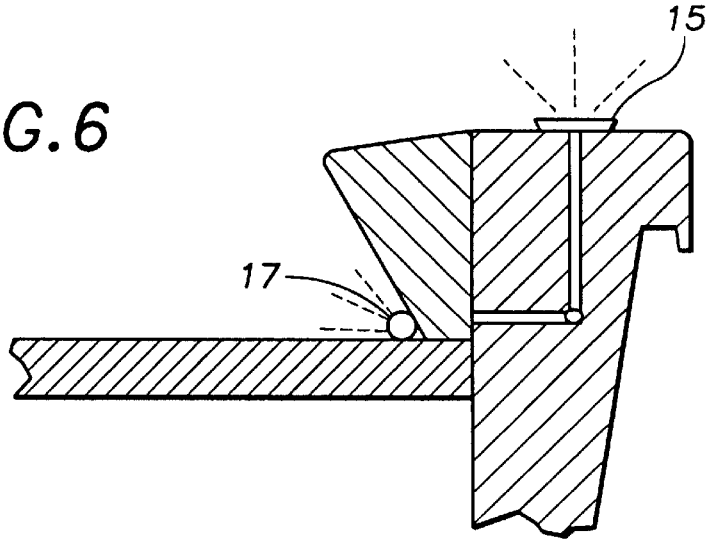
FIG. 6 is a cross section taken along line I of FIG. 1, illustrating the placement of the optic fiber transmitting light on the table edge and to the table distance indicators.
Figure 7:
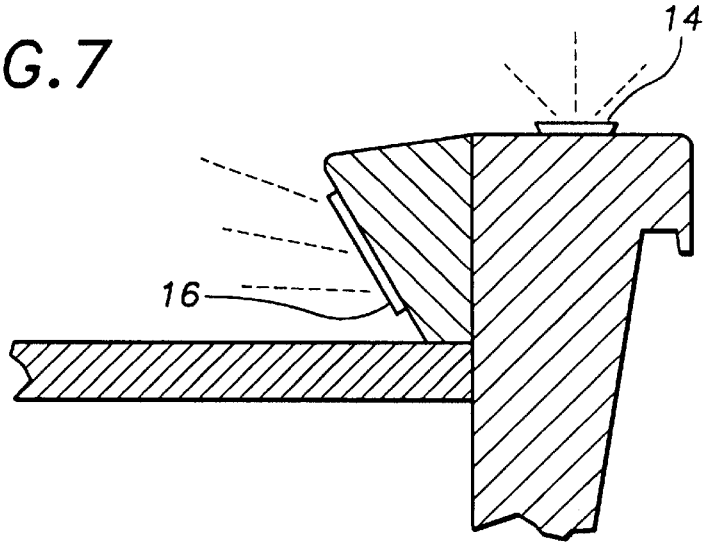
FIG. 7 is a cross section taken along line I of FIG. 1, illustrating the placement of the vinyl luminescent sticker on the table edge and the table distance indicators.
Figure 8:
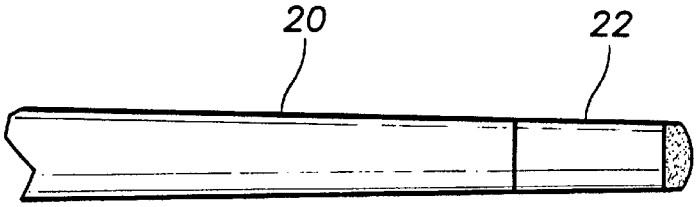
FIG. 8 is a side view of a cue tip illustrating the luminescent material attached.

The illumination portions described above are preferably provided by different illuminating means depending upon the location of the illuminating component. The center points 12 are preferable vinyl stickers with a luminescent additive. The distance indicators may be either vinyl stickers 14 as illustrated in FIG. 7 or clear flattened optic fiber terminal ends 15 as illustrated in FIG. 6. Edge illuminators may be either vinyl stickers 16 as illustrated in FIG. 7, or optic fibers 17 with lateral emitting capabilities as illustrated in FIG. 6. The pocket backs 18 are preferable vinyl stickers. While the cue tips 22 and balls 32 are preferable composed of material which includes an additive making the plastic illuminating.

Figure 3:
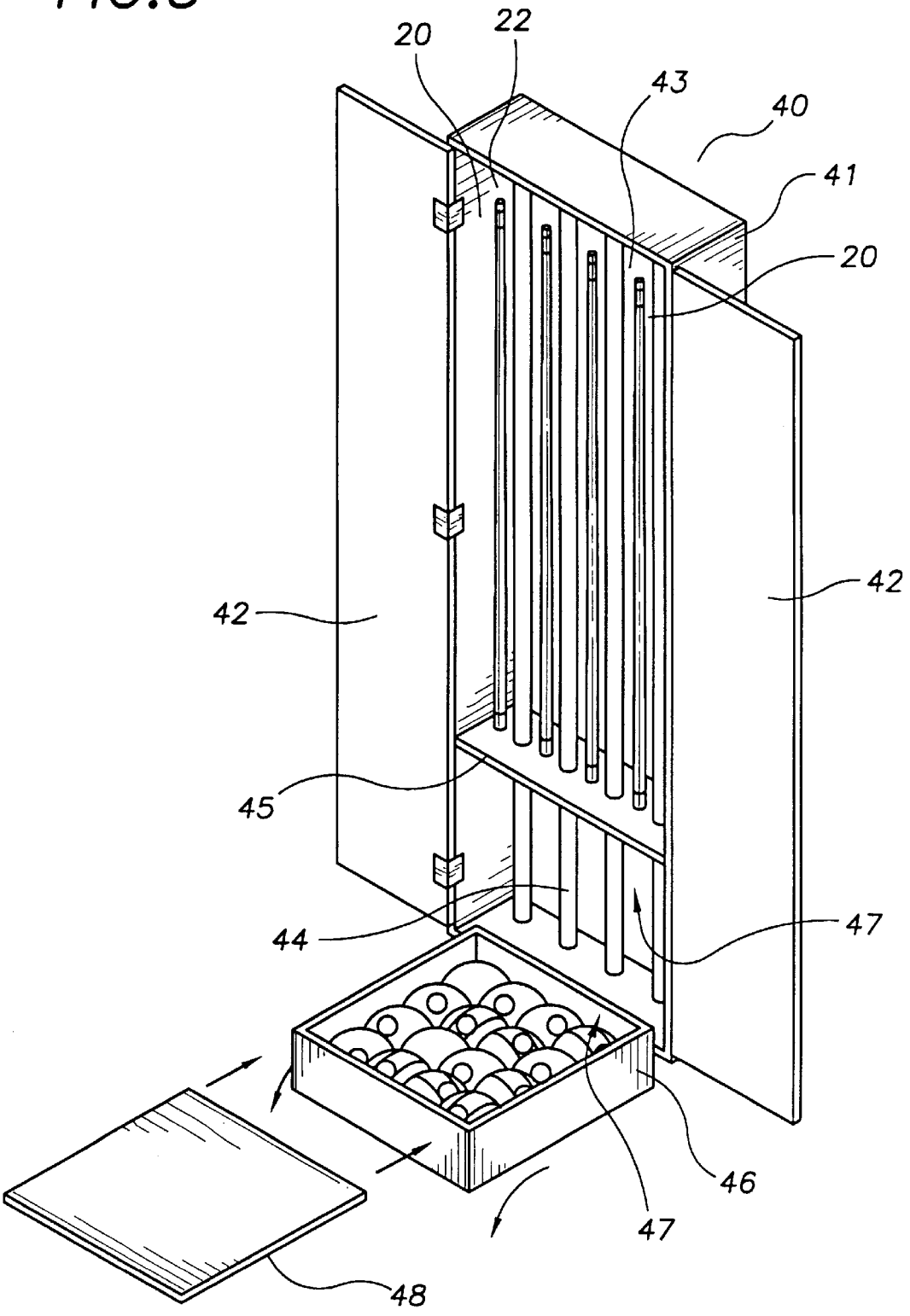
FIG. 3 is an isometric view of an open charging cabinet illustrating the interior of the cabinet with the cue sticks, and light positioned in the interior while the billiard balls are removed to illustrate the location of the lighting means with the balls.
Figure 4:
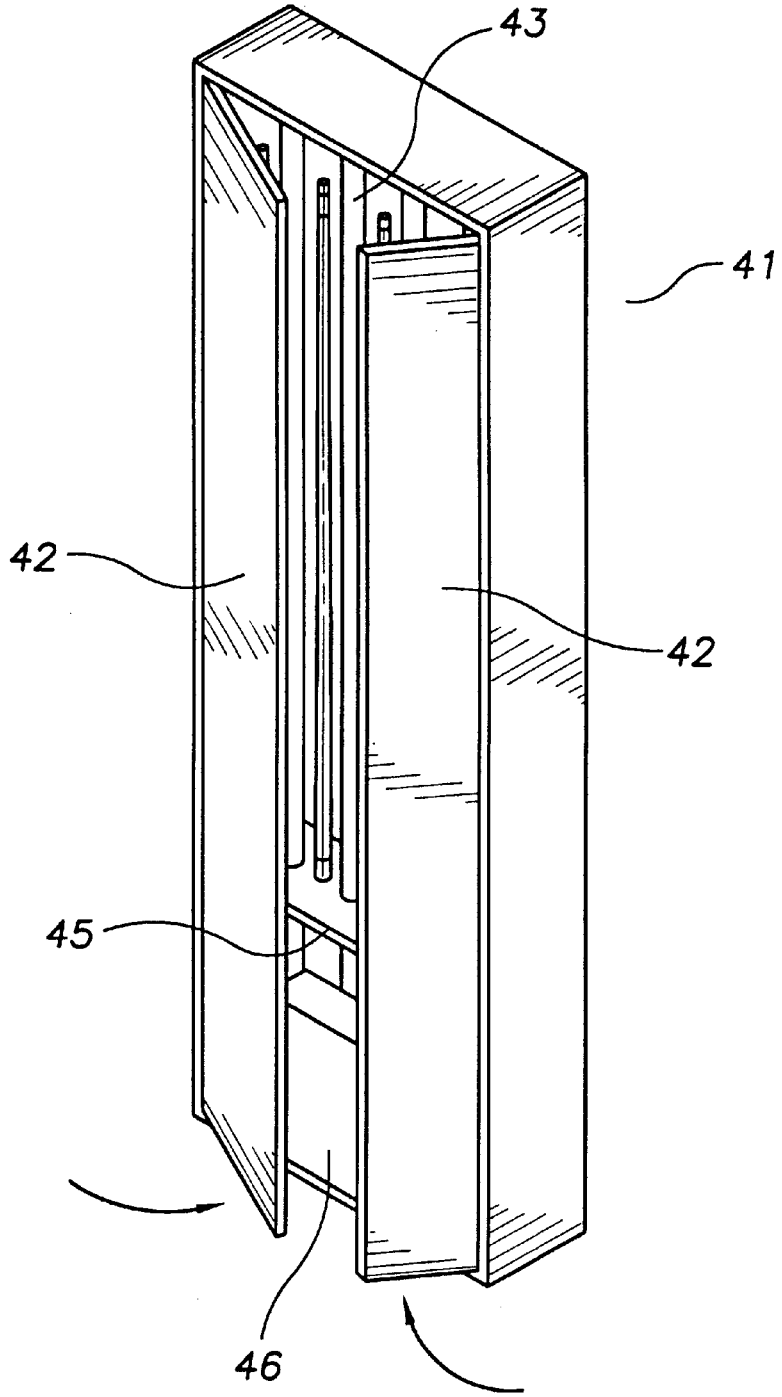
FIG. 4 is a an isometric view of a closing cabinet illustrating the billiard ball container in place.
Figure 5:
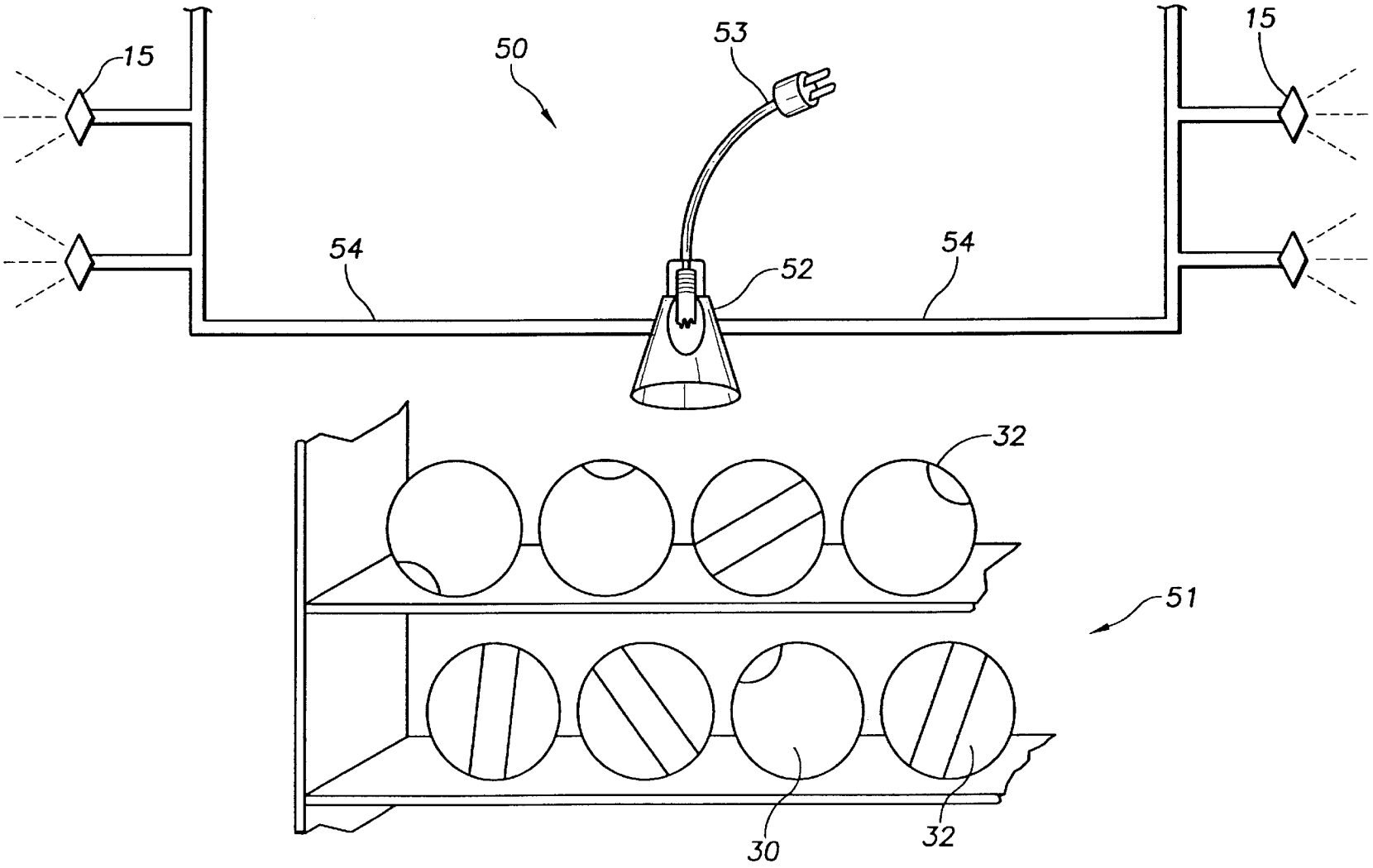
FIG. 5 is a displaced cut-away view of the lighting means for a billiard ball storage bin for a billiard table with automatic ball return, also illustrating an optic fiber coupled to the lighting system which is illustrated transmitting light to the billiard table distance indicators and table edges.

The ball luminescence charging means is illustrated in FIGS. 3,4 and 5. The cabinet charging mean 40 includes the cabinet body 41 which is dimensioned as a rectangular box with hinged doors 42 forming an interior 43 which contains fluorescent light bulbs 44, ball storage box 46, and cue rack 45. The cabinet body 41 is construct of plywood, composite material, plastic, or some other durable construction material. The interior of the cabinet body 43 and the interior of the ball storage box are both preferable lined with a highly reflective material 47 to provide maximum reflectiveness of the light within the containers thus assuring that all surfaces of the balls 32 and the cue tips 22 are fully charged with light. The reflective material is preferably highly polished sheet aluminum. The lighting in the cabinet is preferably fluorescent bulbs which extend the entire height of the cabinet interior. The bulbs should be long enough to extend from the ball storage box 46 to the cue tips 22 in the interior of the cabinet. The ball storage box 46 is removable from the storage cabinet by rotating the box 46 90° out of the cabinet, as illustrated in FIG. 3. A clear plastic top 48 is included on the storage box 46 to prevent the balls 32 from spilling from the box 46, while also allowing light to enter the box. The cabinet light is also equipped with a door activated light on/off switch, which switches the light on only when the doors are closed. Additionally, a timer is preferably also electrically wired to the light so that the light will only stay in the "on" position for a preset time, preventing overheating inside the cabinet.

The storage bin ball charging means 50 is illustrated in FIG. 5. While the location of the automatic return storage bin 51 is illustrated in FIG. 1 at the end on the billiard table. The charging means 50 includes a light source 52 which is preferably a high intensity incandescent light bulb with fixture which is powered by conventional power by cord 53. The light 52 is positioned in the bin 51 so that maximum lighting is directed to the balls 32 as they enter and are stored in the bin 51. Providing the light source in the bin 51 also provides an opportunity to direct some of the light from the bulb 52 to other areas of the table. Optic fibers 54 are located in close proximity to the light source 52 thereby capturing light which is then transmitted to the table edge 17 and the distance indicators 15. The optic fibers 54 may include one or more fibers emanating from the light source. One fiber can be branched numerous times to provide an optic fiber terminal end at several locations of the billiard table. Additionally, the table edge optic fibers 17 are lateral emitting fibers, while the distance indicators 15 emit light at there ends.

It is noted that the embodiment of the Luminescent Billiard Game System described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A luminescent billiard game system, which allows the game of billiards to be played in limited lighting conditions, the game comprising:

a) a means for providing light luminescence on portions of billiard balls, billiard cue stick tips, billiard pockets, a center point of the billiard table, table borders, start line and distance indicators on the billiard table, b) a means for charging the light luminescence on the billiard balls, wherein the means a standing rectangular cabinet body with hinged doors and interior lighting and interior reflective material which interior lighting charges the billiard balls and cue stick tips luminescent portions, wherein the lighting comprises a multiplicity of fluorescent lamps positioned longitudinally within the interior of the cabinet, while the interior also include a rack which supports cue sticks and a ball box which contains the billiard balls and further the box positions the balls to be exposed to the light and further the box includes an interior lined with reflective material, the light further being activated by an on/off switch which is activated to the on position when the doors are closed and off when the doors are open, furthermore the light switch including a timer which automatically turns the switch off after the switch has been on for a designated time.

2. The luminescent billiard game system of claim 1, wherein: the means for light luminescence on the billiard balls and the cue stick tips comprising adding a light sensitive additive to a polymer composition; the polymer forming a ball outer surface and a tip outer surface; the light sensitive additive in the ball outer surface and the tip outer surface providing luminescence to the ball outer surface and the tip outer surface in low light conditions.

3. The luminescent billiard game system of claim 1, wherein: the means for light luminescence on the billiard pockets, table border, center point of the billiard table, start line, and distance indicators on the billiard table, comprises adding a light sensitive additive to a composition which is included in an adhesive sticker and wherein the sticker is cut to conform to the billiard pocket, starting point, table border, distance indicators, and center point and which the outer surface of the sticker provides luminescence in low light conditions.

4. The luminescent billiard game system of claim 1 wherein: the means for light luminescence on the table border, start line, and distance indicators, comprises an optic fiber light illuminating means which transmits light from a light source to the table border, distance indicators, and start line thereby illuminating each, and further wherein the light source comprises a light mounted within a ball collection bin on the billiard table.

* * * * *